US005862523A

United States Patent [19]

Proctor

[11] Patent Number: 5,862,523

[45] Date of Patent: Jan. 26, 1999

[54] MODULAR HEADWEAR SYSTEM

[76] Inventor: Michael K. Proctor, 1000 Dutch Canyon Rd., Midway, Utah 84049

[21] Appl. No.: 857,579

[22] Filed: May 16, 1997

[51] Int. Cl.[6] ..... A42B 1/00

[52] U.S. Cl. ..... 2/209.11; 2/171

[58] Field of Search ..... 2/171, 171.1, 209.11, 2/171.3, 171.4, 171.5, 171.8, 172, 181, 181.6, 182.8, 183, 209.12, 209.13, 209.14, 209.3, 209.4, 209.5, 175.1, 175.7, 195.1, 195.2, 195.3, 195.4, 195.7, 909, 918, DIG. 11

[56] References Cited

U.S. PATENT DOCUMENTS

| | | | |
|---|---|---|---|
| 3,166,766 | 1/1965 | Banello, Jr. | 2/209.13 |
| 3,671,974 | 6/1972 | Sims . | |
| 4,063,740 | 12/1977 | Mader . | |
| 4,179,753 | 12/1979 | Berg et al. | 2/195.3 |
| 4,268,918 | 5/1981 | Lee . | |
| 4,304,005 | 12/1981 | Danley, Sr. . | |
| 4,486,903 | 12/1984 | Krystal | 2/172 |
| 4,545,310 | 10/1985 | Treadwell et al. . | |
| 4,630,317 | 12/1986 | Brown et al. | 2/209.3 |
| 4,712,254 | 12/1987 | Daigie et al. | 2/171 |
| 4,768,231 | 9/1988 | Schrack | 2/918 |
| 4,821,341 | 4/1989 | Baptise . | |
| 4,852,189 | 8/1989 | Duggan | 2/909 |
| 4,873,726 | 10/1989 | Tapia | 2/171.1 |
| 4,918,758 | 4/1990 | Rendina | 2/DIG. 11 |
| 4,961,232 | 10/1990 | Hulsey . | |
| 4,980,928 | 1/1991 | Ellis . | |
| 5,046,195 | 9/1991 | Koritan | 2/209.13 |
| 5,052,056 | 10/1991 | Braun | 2/115 |
| 5,058,210 | 10/1991 | Tivis | 2/181 |
| 5,099,524 | 3/1992 | Linday | 2/181 |
| 5,121,507 | 6/1992 | Brown . | |
| 5,153,943 | 10/1992 | Clement | 2/172 |
| 5,359,734 | 11/1994 | Rathburn | 2/209.13 |
| 5,437,062 | 8/1995 | Douglas | 2/181 |
| 5,473,778 | 12/1995 | Bell | 2/209.13 |
| 5,491,841 | 2/1996 | Valletta | 2/209.13 |
| 5,647,061 | 7/1997 | Marcus | 2/181 X |
| 5,652,959 | 8/1997 | Proctor | 2/195.2 |

FOREIGN PATENT DOCUMENTS

| | | | |
|---|---|---|---|
| 216405 | 5/1924 | United Kingdom | 2/175.7 |
| 2070413 | 9/1981 | United Kingdom | 2/209.12 |

*Primary Examiner*—Gloria M. Hale
*Attorney, Agent, or Firm*—Workman, Nydegger & Seeley

[57] ABSTRACT

A module headwear system worn by a user that comprises a headband having an interior surface and an exterior surface, a first accessory, and first and second attachment members configured to selectively, detachably couple the first accessory to one of the interior surface of the headband and the exterior surface of the headband. The first accessory may comprise a visor, a crown, ear protection, neck protection, or eyeglasses. The module headwear system may also include a passageway configured to provide ventilation to the users' head.

38 Claims, 7 Drawing Sheets

MODULAR HEADWEAR SYSTEM

BACKGROUND OF THE INVENTION

1. The Field of the Invention

The present invention relates to headwear systems and, in particular, to headwear systems that afford selective accessorization of headwear.

2. Present State of the Art

Headwear serves many functions and purposes. Headwear is worn to protect the head or other parts of the upper body. Headwear may also serve as an ornamental component of a wardrobe. Headwear may have the potential to attract attention to the wearer or make a statement relative to the wearer's identity or group association. In some cultures, headwear is worn to show respect and modesty.

A basic component of headwear systems in many cultures is the hat. The top portion of a hat is often referred to as the crown while the bottom portion which surrounds the head substantially above the ears is often referred to as the base. Some styles of hats include a bill and one or more flaps attached to the base of the hat at various locations that project or depend therefrom as determined by fashion or the intended utility of the headwear system.

Weather changes, sometimes quickly and unpredictably. A waterproof hat protects the wearer from the rain, but may be overly warm and uncomfortable when the sun comes out. Similarly, a hat that is light and cool for hot sunny weather may not offer significant protection against a sudden rain shower. A hat that is made to protect the ears or the neck from inclement weather may become burdensome in the sunshine.

There are many types of headwear available that provide protection against the weather. For example, one type of rain protection is headwear that includes a deployable cape. Although the headwear allows a user to selectively protect the user against sudden weather changes, the headwear lacks breathability, retaining heat from the wearer inside the headwear—particularly when the cape is stowed inside the hat. In addition, stowing the cape may result in an uneven surface contacting the head of a wearer. Finally, the headwear will fit differently when the cape is stowed than when the cape is deployed.

Other headwear systems provide for selective attachment of components to a particular surface of the headwear system. One system, for example, provides for selective attachment of a sheet of material to a headband. The system, however, only allows attachment of the sheet of material to certain predetermined portions of the headband.

As another challenge within the art, because of the crown disposed on the user's head, hats typically trap heat within the hat adjacent to the user's brow. Although various attempts have been made to ventilate the hat through mechanical means, such as a fan, for example, mechanical parts are awkward to wear atop a user's head and may appear unsightly. Although the opening at the rear portion of typical baseball hats provides a certain amount of ventilation, the brow typically becomes hot and sweaty, often causing the wearer to remove the hat, and wipe the sweat from the wearer's brow before replacing the hat.

As one option, because of the heat contained within caps, headbands separate from hats, such as sweatbands, are often worn by those engaging in active sports. Headbands can be used to prevent sweat from dripping into a user's face or to keep a user's hair out of the user's eyes. However, headbands alone provide little, if any protection from the sun.

As opposed to hats and mere headbands, visors are often employed by those seeking the protection from the sun afforded by a bill, yet without containing the crown of the cap. Visors are particularly useful on hot, sunny days for those who are interested in shading their eyes or face, yet want to stay cool. Tennis players and golfers, for example, often wear visors because the visor deflects the sun, yet does not retain heat like a hat.

One problem within the art is that the choice between a headband, a hat, and a visor is typically exclusive. If a user desires to have the option of wearing either a headband or a visor on a particular occasion, the user is required to obtain and carry both a headband and a visor. Furthermore, the user desiring the further option of wearing a hat, in the event of inclement weather, for example, must further purchase and carry a separate hat.

Particularly the avid sweatband, hat, or visor wearer develops a particular, individualized fit in the headwear. The headwear demands a certain amount of time to break in and, once broken in, the snug, personalized feel of a well fitting article of headwear is convenient and satisfying. However, typically in order to accessorize and/or alter the appearance or function of the headwear system, the wearer must purchase a new system and lose the fit.

Finally, a hat may be used to reflect personal loyalties or tastes, such as an interest in sports, that the wearer has been to a specific event, or that the wearer is loyal to a certain manufacturer, employer, media corporation, political candidate, or special interest group. Patches having a particular insignia are typically worn on hats to reflect these interests and tastes. The taste or interest of a wearer may change, however, while the patch on the hat is permanent. Accommodating the wearer's changing tastes and attitudes typically requires owning multiple hats and may become costly.

OBJECTS AND SUMMARY OF THE INVENTION

It is therefore an object of the present invention to provide an improved headwear system.

It is a further object of the invention to provide a modular headwear system so that a variety of useful accessories can be included, on a modular, replaceable basis within the headwear system.

It is a further object of the invention to selectively, detachably couple a variety of accessories to various components of the headwear system.

It is a further object of the invention to provide a headwear system including a headband which can be readily converted to a visor, hat or other article of headwear.

It is a further object of the present invention to provide versatile headwear that can adapt to changing weather conditions.

It is a further object of the invention to provide ventilation to the interior surface of a cap adjacent the brow of a wearer.

It is an object of the present invention to provide headwear that can be selectively personalized.

It is a further object of the invention to provide a headband in which a visor or other accessory may be placed within the headband at any position along the length of the headband.

It is a further object of the invention to provide a headwear system in which insignia on the system can readily be replaced.

The modular headwear system of the present invention is comprised of (i) a headband having an interior surface and an exterior surface; (ii) a first accessory; and (iii) means for selectively, detachably coupling the first accessory to one of the interior surface of the headband and the exterior surface of the headband.

The headband of the present invention comprises an endless band which surrounds the head of the wearer. A variety of examples of the headband will be illustrated. In addition, a variety of different accessories may be employed in conjunction with the headband, including a visor, a crown, ear protection, neck protection, eyeglasses or other eye protection and other accessories. In one embodiment, a single accessory is selectively, detachably coupled to the headband. In another embodiment, however, a variety of accessories are selectively, detachably coupled to the headband and/or each other. The accessories may attach to the interior surface of the headband, the exterior surface of the headband, or both.

In one embodiment, a rim of the visor is selectively disposed between the interior surface of the headband and the head of the user. Thus, the headband can be selectively used as a headband alone or may include an attached visor. Because of the replaceable nature of the visor, it is possible to employ a variety of different visors. In yet another embodiment, a cap is selectively, detachably coupled to the headband either with or without the visor.

In one embodiment, the headwear system includes both a visor and an attached cap and means for venting the interior cavity of the cap. The venting means may comprise, for example, the rim of the visor including a hollow rim cavity defining a passageway from a lower end of the rim to the upper end of the rim, thereby allowing air to flow between the interior cavity of the cap and the environment. The passageway provides ventilation to the portion of the user's head adjacent the interior surface of the cap.

In one embodiment, a means for covering the cap is employed for protection against the environment and/or to alter the appearance of the headwear system. The covering means includes means for selectively, detachably coupling a base of the covering means to the base of the cap.

In another embodiment, the headwear system includes an accessory, such as a patch, which displays insignia, the accessory selectively, detachably coupled to the cap. The patch may either be detachably coupled directly to the cap, or may be detachably coupled to another patch which is either permanently or detachably coupled to the cap. The modular patch is useful for those interested in selectively altering the visual indicia of the headwear system, such as the sports fan who originally cheers for one school, but decides for whatever reason to cheer for another school, for example. The patch may also include means for venting the interior cavity of the cap.

It will be appreciated that in light of the modular components provided herein, it is possible for a user to build the user's own headwear system, comprised of various components selected by a user.

Additional objects and advantages of the invention will be set forth in the description which follows, and in part will be obvious from the description, or may be learned by the practice of the invention. The objects and advantages of the invention may be realized and obtained by means of the instruments and combinations particularly pointed out in the appended claims.

BRIEF DESCRIPTION OF THE DRAWINGS

In order that the manner in which the above-recited and other advantages and objects of the invention are obtained, a more particular description of the invention briefly described above will be rendered by reference to a specific embodiment thereof which is illustrated in the appended drawings. Understanding that these drawings depict only a typical embodiment of the invention and are not therefore to be considered limiting of its scope, the invention will be described and explained with additional specificity and detail through the use of the accompanying drawings in which.

DESCRIPTION OF THE PREFERRED EMBODIMENTS

Figure 1:
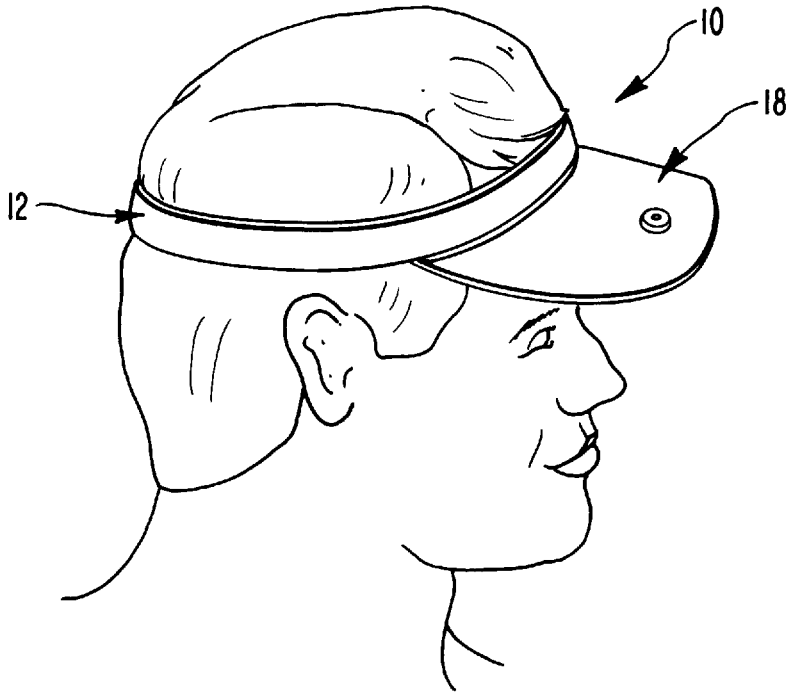
FIG. 1 is a perspective view of a modular headwear system of the present invention.
Figure 2:
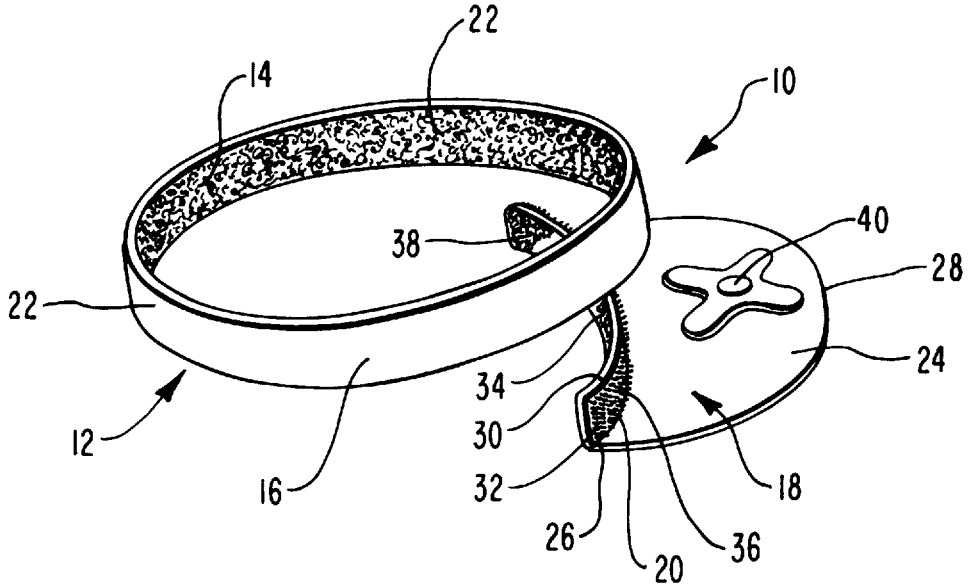
FIG. 2 is an exploded view of the modular headwear system of FIG. 1.

The present invention relates to modular headwear systems worn by users. With reference now to FIGS. 1 and 2, an embodiment of a modular headwear system 10 is comprised of (i) a headband 12 having an interior surface 14 and an exterior surface 16; (ii) a first accessory, such as visor 18; and (iii) means for selectively, detachably coupling the first accessory to one of interior surface 14 of headband 12 and exterior surface 16 of headband 12.

Headband 12 may be comprised of a variety of materials and configurations, as will be discussed in detail below. It will also be appreciated from a review of FIGS. 1–8 that a variety of accessories may be selectively, detachably coupled to the interior and/or exterior surface of headband 12 and to each other. Thus, headwear system 10 may comprise first, second, third, and fourth accessories, and so on. The accessories may comprise a wide variety of objects, such as articles of clothing, advertising materials, ornaments, or any other object or member which covers, decorates, provides protection, personalizes, advertises, identifies, or individualizes the headwear system. Specific examples of accessories will be discussed in detail below. Because of the wide variety of accessories available, headwear system 10 provides a great deal of modularity, thereby allowing the user to wear the system in a variety of different modes.

One embodiment of a means for selectively, detachably coupling an accessory to a desired surface comprises: (i) a first attachment member; and (ii) a second attachment member which releasably engages the first attachment member. As shown in FIG. 2, in one embodiment, the first and second attachment members comprise a pile material 22 and a hook material 20, respectively, of a hook and pile fastener, such as VELCRO. Pile material 22 has cooperating eyelet fibers adapted to be releasably engaged by the hooked locking fibers on hook material 20.

A hook and pile fastener and a variety of other fasteners may be used on any of the selectively detachable accessories disclosed throughout this specification and the appended claims to selectively, detachably couple an accessory to a desired surface. Other examples of first and second attachment members optionally used for any of the selectively detachable accessories disclosed throughout this specification and the appended claims include: (i) a male snap component and a female snap component, respectively, of a snap in fastener, (ii) a hook and eye, respectively, of a hook and an eye fastener; and (iii) a plurality of protuberances and apertures adapted to receive the protuberances in a snapping arrangement, respectively. These first and second attachment members may be comprised of a variety of materials, including plastic, rubber, metal and a variety of other materials.

Other embodiments of means for selectively, detachably coupling an accessory to a desired surface will be discussed below, including endless elastomeric bands coupled to a particular accessory and apertures through which a particular accessory is disposed.

As mentioned above, one example of headband 12 is demonstrated in FIGS. 1 and 2. As shown in FIG. 2, headband 12 can selectively be employed in conjunction with an accessory or separate from the accessory. Thus, if a user no longer desires to couple an accessory to headband 12, the user can use headband 12 alone as a sweatband.

The headband of the present invention comprises an endless band which surrounds the head of the wearer, such as a sweatband. As shown in FIG. 1, in one embodiment, headband 12 of the present invention comprises a single endless circular band which surrounds the head of the wearer. In another embodiment, as discussed in detail below with reference to FIG. 6, the headband is comprised of a plurality of members coupled to form an endless band which surrounds the head of a wearer, such as a first member selectively, detachably coupled to a second member in order to form an endless band which surrounds the head of the wearer. Other examples of the headband will be discussed in additional detail below.

Headband 12 can be designed from a variety of materials, such as cotton, and can be manufactured in a variety of manners, such as a flexible knit. In one embodiment, headband 12 includes a first attachment member such as pile material 22 for attachment to a second attachment member, such as hook material 20 on one or more accessory. Hook material 20 may be attached to the accessory through the use of an adhesive or other means for permanently securing hook material 20 to the accessory.

Either interior surface 14 or exterior surface 16 of headband 12, or both of the surfaces may be comprised of a first attachment member, such as pile material 22, or a second attachment member such as hook material, for attachment to an accessory having a corresponding attachment member. Pile material 22 is preferable to hook material on the interior surface of the headband because of its smoother, more comfortable interface with the head of the wearer.

In one embodiment, the entire interior surface and/or exterior surface of headband 12 comprises the first or second attachment member. The advantage of this embodiment is that an accessory can be selectively oriented in any location along the length of the interior and/or exterior surfaces headband 12. Thus, visor 18, for example, can be worn oriented frontwards (as shown in FIG. 1) backwards, on the side, or a number different angles therebetween. In one embodiment, the exterior surface 16 or interior surface of headband 12 is comprised of a pile backing material. The accessory may also be comprised of a desired attachment member.

Thus, one example of means for selectively, detachably coupling an accessory to one of the interior and exterior surfaces of the headband comprises the headband itself comprising a first or second attachment member or having a first or second attachment member coupled thereto and the accessory comprising a corresponding second or first attachment member or having a corresponding second or first attachment member coupled thereto.

As discussed above, detachable visor 18 is one example of an accessory. Detachable visor 18 is useful for a variety of different individuals, such as a gardener, tennis player or golf professional desiring modularity with a visor 18. Thus, a wearer can continue to wear the same headband 12 which has become custom fitted to a wearer's head through continual use, yet employ a visor 18 having different colors, shapes, weights or materials. The detachable nature of visor 18 also allows headband 12 to be selectively used merely as a sweatband, if desired, for example.

Visor 18 includes (i) a bill 24 having a proximal end 26 and a distal end 28; and (ii) a rim 30 having a distal surface 32, a proximal surface 34, and means for cushioning the head of the wearer, such as terry cloth or other cushioning material disposed against proximal surface 34. Distal surface 32 of rim 30 is coupled to the proximal end 26 of bill 24.

In one embodiment, the means for selectively, detachably coupling the first accessory to one of the interior surface 14 of headband 12 and exterior surface 16 of headband 12 comprises a second attachment member, such as a hook material 36 disposed on distal surface 32 of rim 30 for attachment thereof to pile 22 on the interior surface 14 of headband 12, as shown in FIGS. 1 and 2. It will be appreciated that reversing the position of the hooked locking fibers 36 on visor 18 and cooperating eyelet fibers 22 on headband 12 would result in an equally effective first and second attachment means.

Terry cloth 38 or other cushioning material is disposed against the proximal surface 34 of rim 30 through the use of permanent securing means, such as an adhesive, for example. Terry cloth 38 is employed in a thickness of about ¼ to about ⅓ inches in one embodiment. In one embodiment, bill 24 of visor 18 includes an aperture 40 for convenient storage of headwear system 10 on a hook mounted, for example, on a wall.

In one embodiment, bill 24 is embossed with a design reflecting a particular theme, time of year, or athletic activity. By way of example, bill 24 may be comprised of cloth, plastic or leather. Visor 18 may also comprise a variety of optional features, such as a venting means, discussed in detail below, and additional ornamentation and designs, discussed in detail below.

The detachable nature of visor 18 allows the user to select a particular visor 18 for a particular time of year or activity and allows the user to selectively wear a sweatband, rather than a visor. The separate headband and visor also assist in manufacturing, allowing the manufacturer to manufacture the visor and headband separately.

Another example of a headwear system 44 is shown in FIGS. 3 through 5*a*. Headwear system 44 comprises headband 45, visor 48 and, as additional examples of selectively detachable accessories, cap 46, and first and second patches 100, 108.

By having a first accessory, such as visor 48, and a second accessory, such as cap 46, and third and fourth accessories, such as first and second patches, 100, 108, a variety of different accessorization possibilities are available. Thus, a user may wear a different cap, a different visor, or different caps and visors for a particular occasion. The caps may be alternately accessorized with a variety of different patches, depending upon a particular occasion.

As shown, each of the interior and exterior surfaces 47, 49 of headband 45 may be comprised of a first attachment member, such as pile material 51, or a second attachment member such as hook material, for attachment, at any location along the length of the interior and exterior surfaces of headband 45, of an accessory having a corresponding attachment member. For example, it will be appreciated that it is possible to provide hook material on a proximal surface of rim 80 of visor 48 for selective detachable coupling to exterior surface 49 of headband 45. Visor 48 also features a tassel 41 or other ornament thereon.

Figure 3:
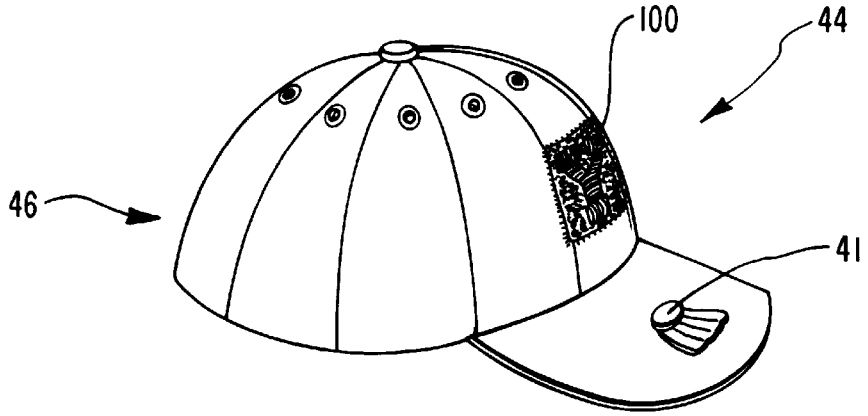
FIG. 3 is a perspective view of another modular headwear system of the present invention.
Figure 4:
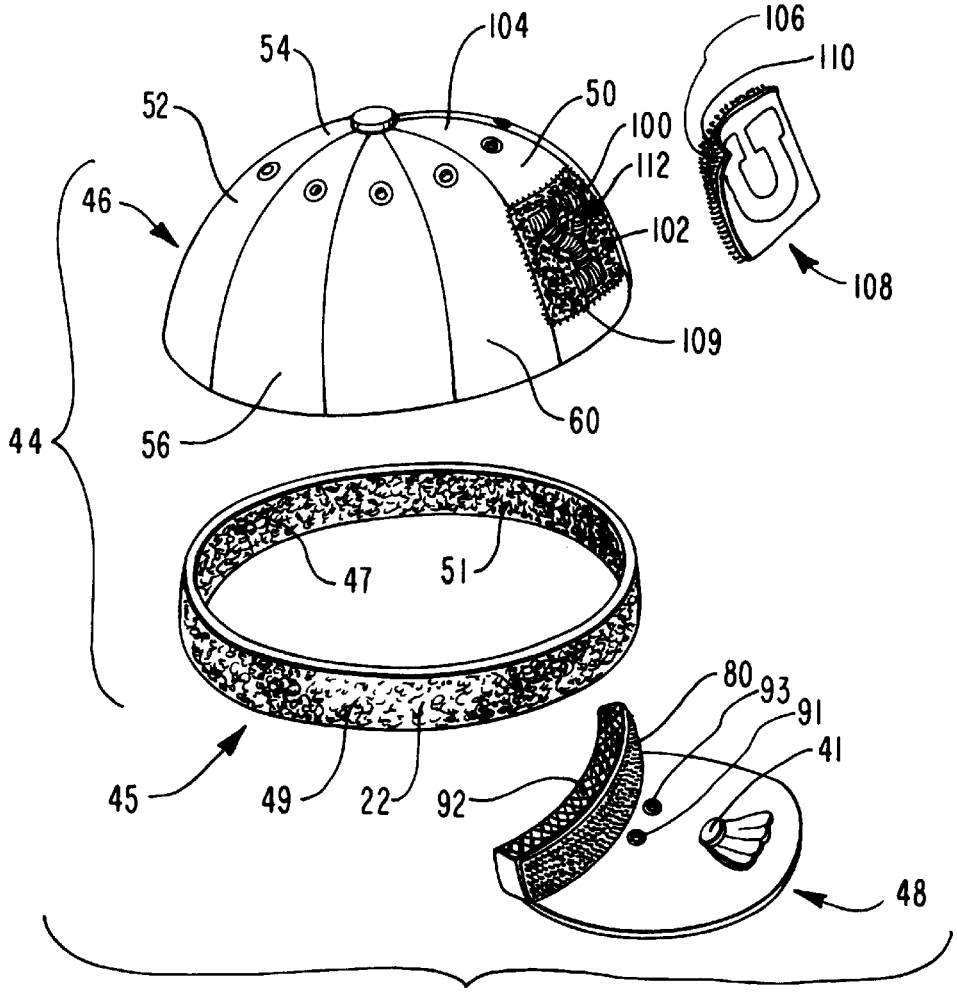
FIG. 4 is an exploded view of the modular headwear system of FIG. 3.

The term "cap" 46 refers to the portion of hat 44 that covers the crown of the head of the wearer. Cap 46 has a front 50, a back 52, a crown 54 which covers the top portion of the head, and a base 56, which surrounds the head substantially above the ears. Cap 46 also has an interior surface 58 (see FIG. 5), and an exterior surface 60. One embodiment of cap 46, as shown in FIGS. 3 and 4 includes a closed, prefitted back. Another embodiment of a cap 62 (shown in FIG. 6) includes a cap 62 having an opening 64 in the back interrupting base 66, as will be discussed in more detail below. The interior surface 58 of cap 46 defines an interior cavity 68.

Figure 5:
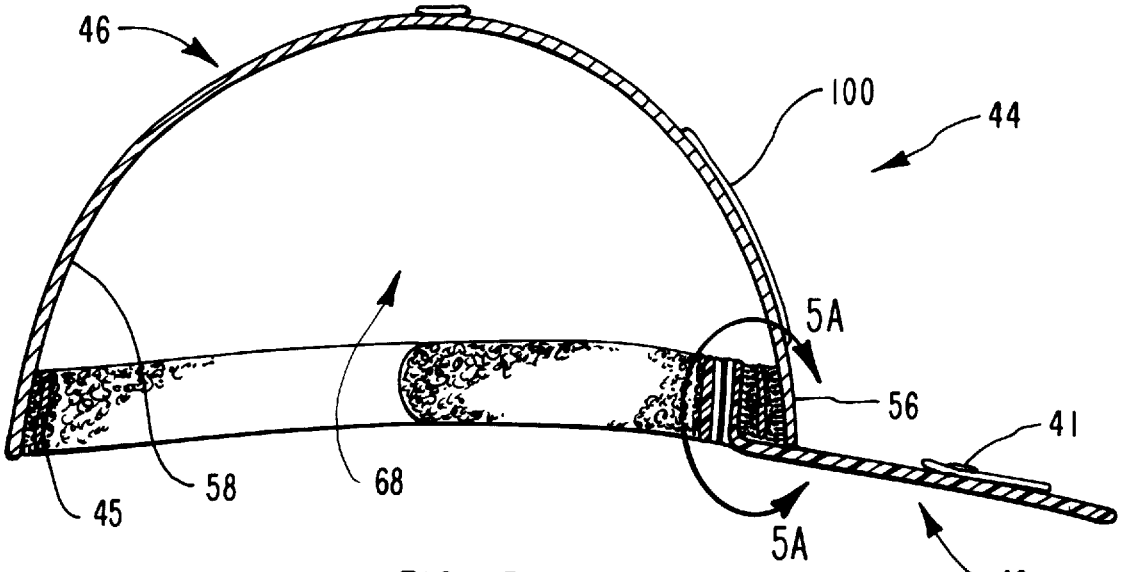
FIG. 5 is a cross-sectional view of the modular headwear system of FIG. 3.
Figure 5A:
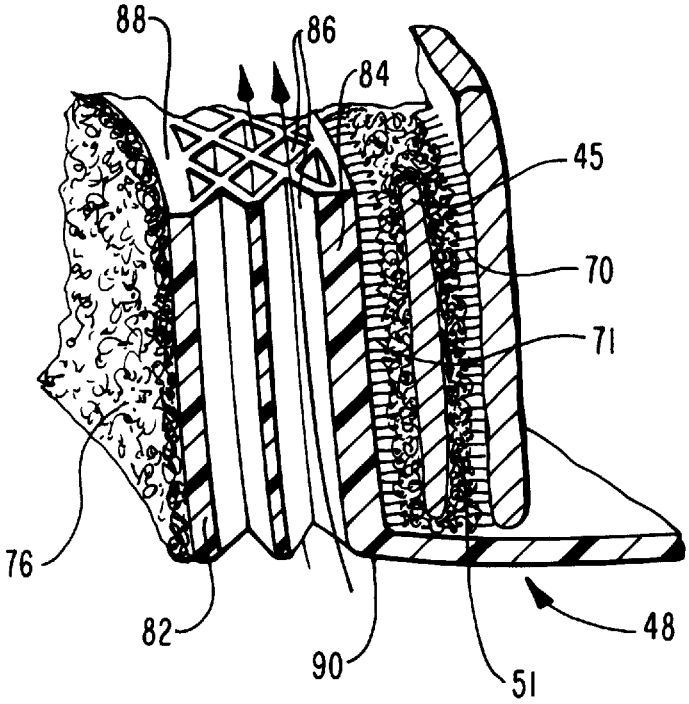
FIG. 5*a* is an enlarged, cut away view of a portion of the headwear system shown in FIG. 5.

As shown in FIGS. 4–5*a,* system also includes second means for selectively, detachably coupling a second accessory, such as cap 46, to one of the interior and exterior surfaces of headband 12. As shown, the exterior surface 49 of headband 45 includes pile material 51, which is releasably engaged by hook material 70 on the interior surface 58 of cap 46, while the pile material 51 on the interior surface 47 is releasably engaged by hook material 71 on the distal surface 84 of rim 80. A terry cloth material 76 on the proximal surface 82 of rim 80 provides cushioning for the head of the wearer. Cap 46 is selectively, detachably coupled to headband 45, which is selectively, detachably coupled to visor 48.

Figure 5B:
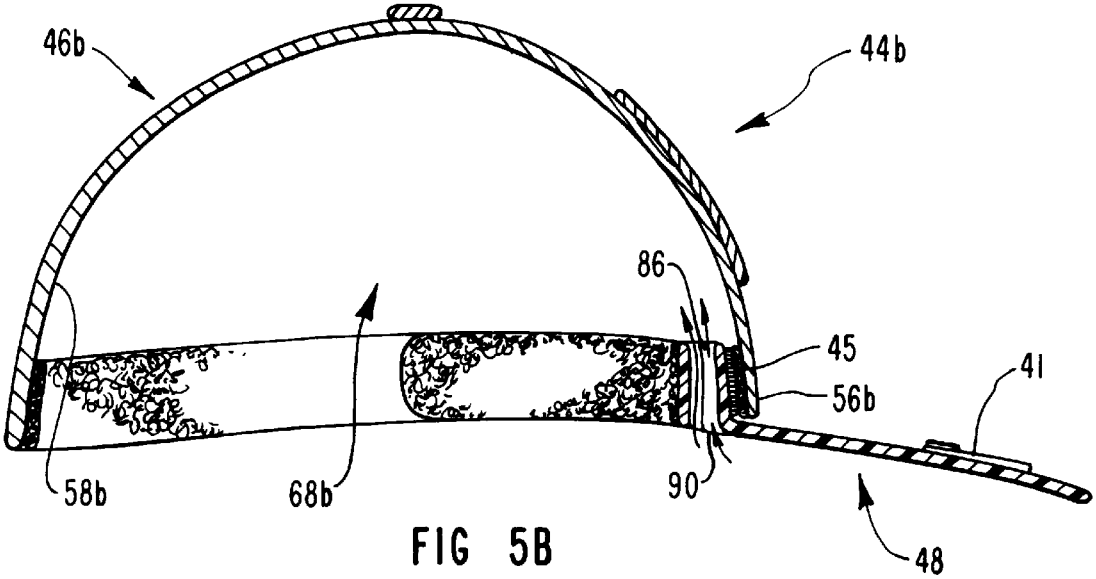
FIG. 5*b* is an alternative embodiment of a headwear system.

In another embodiment, as shown in FIG. 5*b,* visor 48 is selectively, detachably coupled to headband 45, while headband 45 is permanently coupled to cap 46*b*. Optionally, visor 48 is permanently coupled to headband 45 (or headband 12 of FIG. 2, for example) through a permanent securing means such as an adhesive or stitching while headband 45 (or headband 12) is either selectively, detachably coupled to cap 46*b* or is permanently coupled to cap 46*b*.

Figure 5C:
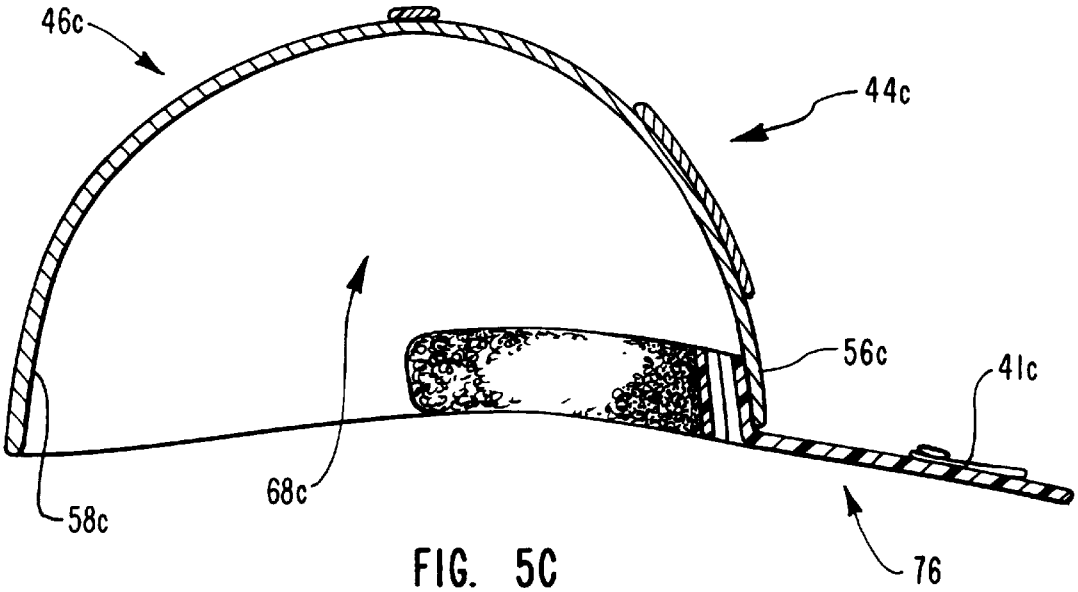
FIG. 5*c* is an alternative embodiment of a headwear system.

In yet another embodiment, as shown in FIG. 5*c,* the headband is integral with the interior surface of base 56*c*. In another embodiment, the interior surface of base 56 comprises the headband. Thus, by being disposed against the interior surface of base 56*c* of cap 46*c,* an accessory, such as visor 76 is disposed against the headband of headwear system 44*c*. Visor 76 may be permanently coupled to base 56*c* through the use a permanent securing means, such as by being sewn to cap 46*c* or by being attached by an adhesive. Alternatively, visor 76 is selectively, detachably coupled to base 56*c*.

In yet another embodiment (not shown) base 56 is folded underneath headband 45 for coupling of a portion of base 56 to the interior surface 47 of headband 45. In this embodiment, the interior and exterior portions of base 56 disposed inside cavity 68 act as a headband to which accessories such as visor 48 may be selectively, detachably coupled.

As further shown in FIGS. 4–5*c,* in one embodiment, headwear system 44 includes means for venting the interior cavity 68 of cap 46. As an example of the venting means, in one embodiment, rim 80 of visor 48 has a proximal wall 82, a distal wall 84, and a series of hollow rim cavities 86 located between the proximal and distal walls, each cavity 86 defining a passageway extending between an upper end 88 and lower end 90 of rim 80. Hollow rim 80 permits the flow of air between the interior cavity 68 of cap 46 and the environment.

Figure 7:
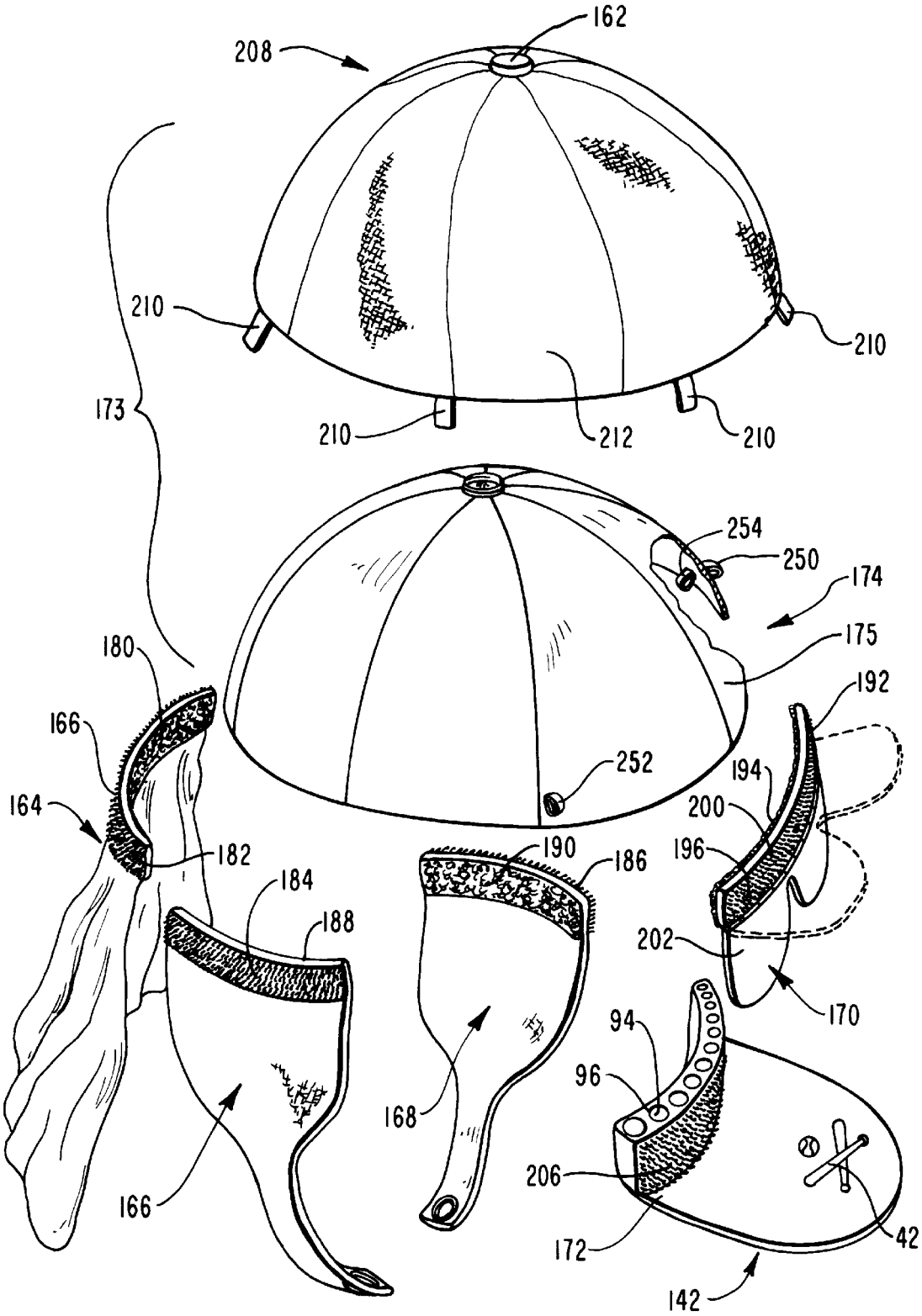
FIG. 7 is an exploded view of another embodiment of a modular headwear system featuring a variety of selectively detachable components. A portion of the cap is shown in a cutaway view.

Rim 80 may have a cross sectional structure in the shape of a honeycomb or corrugation 92, to provide structure, yet allow ventillation. Rim 80 may optionally include a plurality of circular shaped apertures 94 extending between the upper end and lower end of rim 96 as shown in FIG. 7, or a variety of other shapes which accomplish the purpose of forming at least one hollow cavity extending between the upper end 88 and lower end 90 of rim 80 and located between the distal and posterior walls 84, 82 of rim 80.

Also as shown in FIG. 4, as an example of means for selectively, detachably coupling an accessory to visor 48, visor 48 includes first and second grommets 91, 93 for selective detachment of an accessory to visor 48, through the use of a detachable cable, such as a string. By employing first and second grommets 91, 93, a string may be laced through both grommets 91, 93, thereby detachably securing an accessory such as a tassel to visor 48. In another embodiment, the cable is laced through grommets 91, 93 to permanently couple the accessory to visor 48.

With continued reference to FIGS. 3 and 4, another example of an accessory for use in the present invention comprises an accessory displaying insignia, such as modular first patch 100 having a proximal surface (not shown) and a distal surface 102.

Because of this modular patch 100, it is possible to make the headwear system event specific—providing a particular appearance, design, or advertisement for a particular occasion, then alternating the design for the next event. The modular patch is ideal for the fair weather fan or for the fan who cheers for one school for one sporting event or for another school for another sporting event. Thus, rather than purchasing a new cap, the fair weather fan can wear one insignia during one part of the year, then wear another insignia during another part of the year.

The invention further comprises means for selectively, detachably coupling an accessory, such as first patch 100 to a desired surface, such as cap 46, another patch, or another accessory. In one embodiment, the means for selectively, detachably coupling first patch 100 comprises a first attachment member (not shown) on the desired surface and a second attachment member (not shown) on first patch 100.

By way of example, in one embodiment, the first attachment member is disposed on the exterior surface 60 of cap 46, while the second attachment member is disposed on the proximal surface (not shown) of first patch 100. For example, cap 46 may be comprised of a pile material, or optionally, a portion of pile material may be disposed on the exterior surface of cap 46, while the proximal surface of patch 100 includes a hook material for releasable engagement with the pile material.

Also by way of example, in another embodiment, as shown in FIGS. 3 and 4, first patch 100 is coupled, either selectively, detachably or permanently, to the exterior surface 60 of cap 46, while another accessory, such as a second patch 108 is selectively, detachably coupled to first patch 100 through the use of means for selectively, detachably coupling the second accessory to the distal surface of the first accessory. In one embodiment, first patch 100 is stitched to cap 46. In another embodiment, the distal surface 102 of first patch 100 includes a first attachment member, while the proximal surface 106 of second patch 108 includes a second attachment member.

For example, the first attachment member on the distal surface 102 of the first patch 100 may be comprised of a pile 109 or chenille material, while the proximal surface 106 of the second patch 108 includes a hook material 110 for releasable engagement with the pile material 109 on the first patch.

First patch 100 may have insignia 112 stitched on the distal surface thereof. In one embodiment, for example, first patch comprises a pile material or other attachment member and insignia 112 is stitched into the attachment member. In another embodiment, chenille or pile material 104 or other attachment member on first patch 100 is disposed adjacent insignia 112 on patch 100. In yet another embodiment, insignia 112 comprises the first attachment member, such as by being comprised of a pile material. First patch 100 thus displays insignia and simultaneously provides a first attachment member for selectively, detachably coupling second patch 108 thereto.

Figure 6:
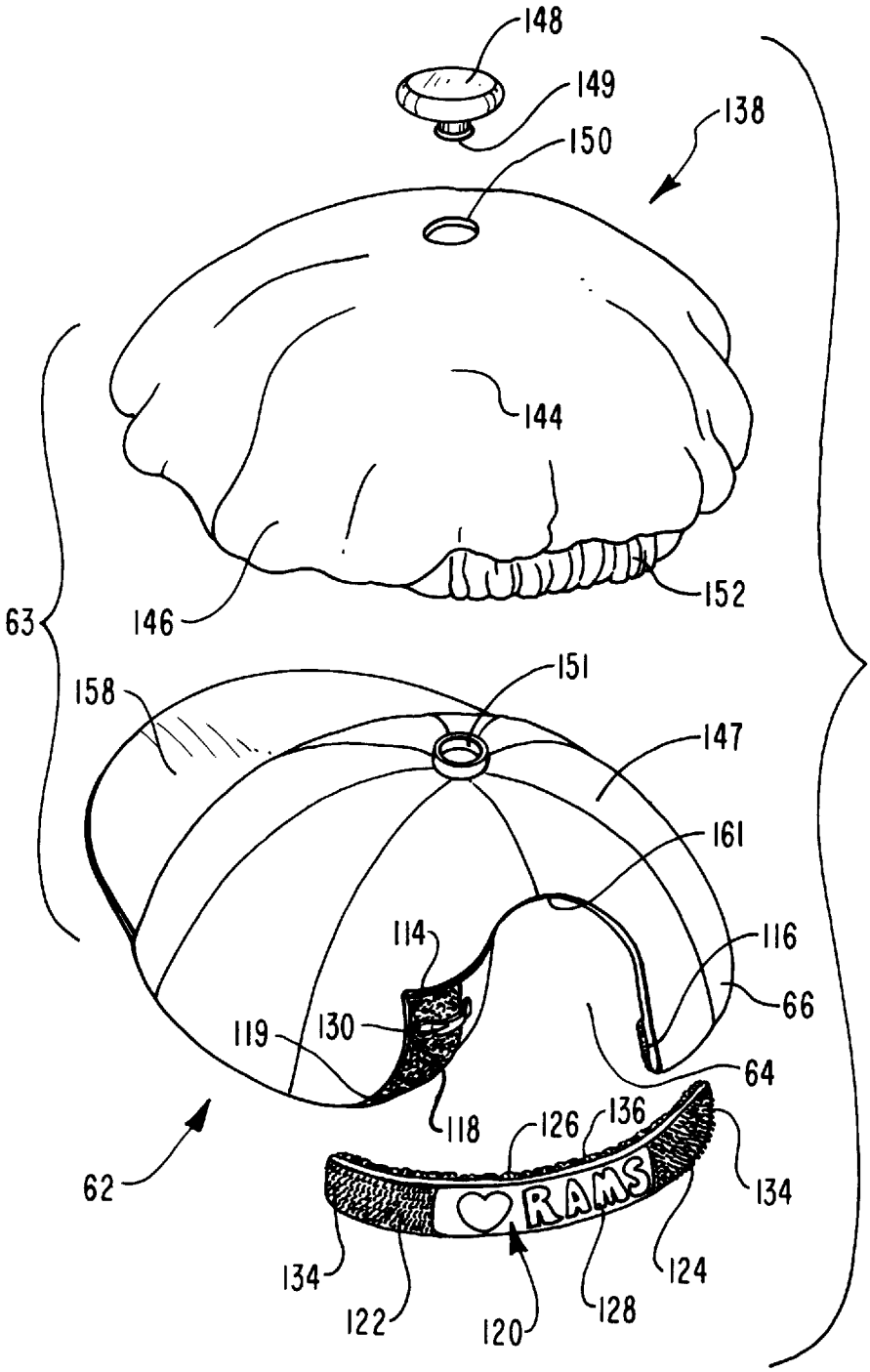
FIG. 6 is an exploded view of another modular headwear system of the present invention.

Another example of a headwear system 63 is shown in FIG. 6. Headwear system 63 comprises a cap 62, a visor 158 which is permanently, or optionally, selectively, detachably coupled to cap 62, a detachable backstrap 120, and a cover 138. Cap 62 has an opening 64 in the back interrupting base 66 of cap 62. Opening 64 may be of any size or shape, but has a first side 114 and a second side 116.

As shown, another embodiment of a headband is formed by coupling detachable backstrap 120 to opposing sides of the interior surface of base 66 of cap 62, thereby forming an endless band surrounding the head of the wearer in such a manner as to couple headwear system 63 to the head of a user. Detachable backstrap 120 has a first end 122, a second end 124, an interior surface 126, and an exterior surface 128.

The invention further includes means for selectively, detachably coupling the detachable backstrap 120 to base 66. In one embodiment of open ended cap 62, a first attachment member 118 such as a pile material extends from first side 114 of opening 64 along inside of base 66 to second side 116 of opening 64. The first attachment member is releasably engaged by a second attachment member 134 on corresponding sides 122, 124 of detachable backstrap 120.

First and second attachment members 118, 134 may also be comprised of a male and female snap component, respectively, a hook and eye, respectively, and a plurality of protuberances and apertures, respectively, or a variety of other attachment members.

As shown in FIG. 6, in one embodiment the interior surface 119 of base 66 includes a band 130. Band 130 has an upper end and a lower end, the upper and lower ends coupled to the interior surface 119 of base 66, forming a loop for disposition of detachable backstrap 120 therethrough. Band 130 thus assists in locating detachable backstrap 120 properly with respect to first attachment member 118.

Also as shown in FIG. 6, according to one aspect of the present invention, headwear system 63 may also be provided with means for covering cap 62, such as cover 138 shown in FIG. 6. The covering means is useful in a variety of settings. For example, in addition to having opening 64, cap 62 may also be comprised of a breathable, wool material. In the event of inclement weather, cover 138, made from a water resistant material, for example, may be disposed about cap 62 to cover opening 64, and to prevent leakage of water through the breathable material. Cover 138 may also be employed to selectively alter the aesthetic appearance of system 63.

Cover 138 includes a panel 144 and a base 146 which, in one embodiment, are loosely contoured to the actual shape of cap 62. Panel 144 covers crown 147 of cap 62, while base 146 extends radially outward from panel 144 to be coextensive with base 66 of cap 62. In another embodiment, panel 144 and base 146 fit snugly about cap 62.

Cover 138 is coupled to cap 62 through means for selectively, detachably coupling cover 138 to cap 62. For example, as shown in FIG. 6, a male snap component 149 of button 148 may be disposed through an aperture 150 in cover 138 and adapted to be coupled with a female snap component 151 on cap 62, thereby securing panel 144 of cover 138 to cap 46. It will appreciated that the locations of the male and female snap components may be readily reversed.

To secure base 146 of cover 138 to cap 62, a gathered portion 152 of base 146 may comprise an elastomeric material or have an elastomeric material disposed therein to squeeze base 146 of cover 138 tightly around base 66 of cap 62, the gathered portion 152 serving as another example of means for selectively, detachably coupling base 146 of cover 138 to base 66 of cap 62.

In one embodiment, cap 62 is comprised of a mesh material, such as a microfilament microfiber product. This material provides form to cap 62, giving cap 62 stiffness. Thus, when limp cover 138 is dispersed about cap 62, cap 62 retains its form, and therefore, retains cover 138 disposed in a structurally organized manner about cap 62.

As discussed above, cover 138 may be comprised of a water proof material, such as GORTEX, nylon or neoprene. In yet another embodiment, cover 138 is designed for selectively alternating the appearance of headwear system 63 and comprises a cloth material, such as cotton, wool, or polar fleece. The style, appearance, and material of each cover 138 may vary, providing a number of different accessory options.

Figure 6A:
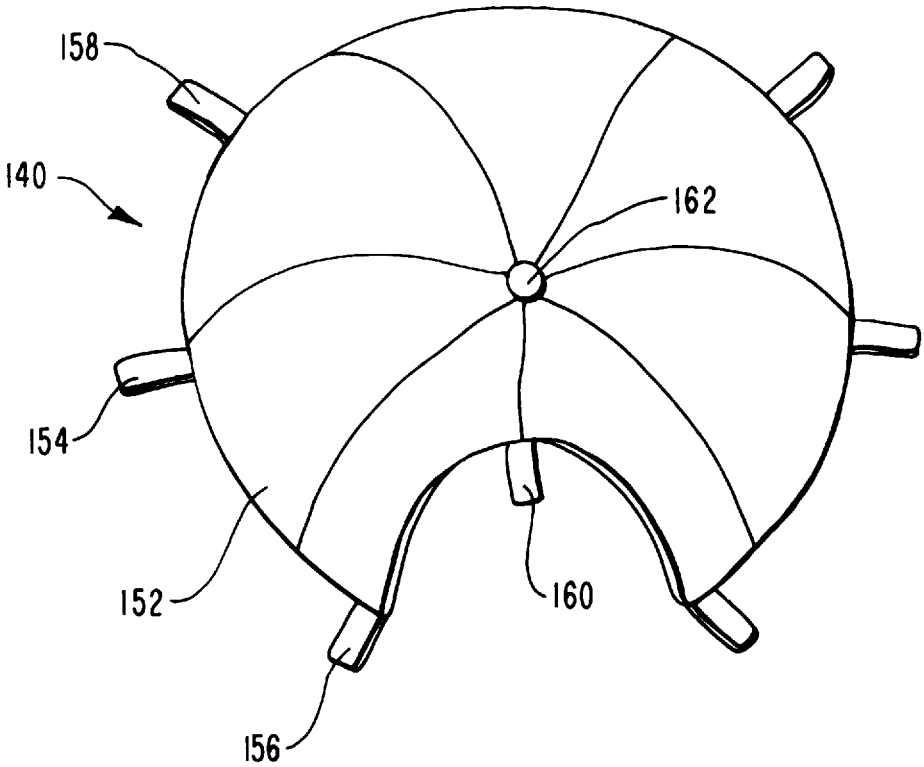
FIG. 6*a* is a view of an alternate cover to be selectively disposed on the cap featured in FIG. 6.

As shown in FIG. 6*a,* in yet another embodiment of headwear system 63, the means for selectively, detachably coupling base 152 of cover 140 to base 66 of cap 62 includes tabs 154, 156, 158 extending from the base 152 of cover 140, the tabs having a second attachment member on interior surfaces thereof (not shown) which couple to a first attachment member on the interior surface 119 of base 66 of cap 62 (FIG. 6). For example, tabs 154, 156, 158 of cover 140 may include a hook material on the interior surfaces (not shown) thereof for attachment to the pile material 118 on the interior surface 119 of base 66 of cap 62.

In one embodiment, detachable backstrap 120 comprises a first attachment member such as pile 136 on the interior surface 126 thereof for attachment to proximal tabs 156. In another embodiment, proximal tabs 156 are disposed between pile 118 and a non-hook surface of backstap 120 adjacent loop 130.

The intermediate tabs 154 of cover 140 of FIG. 6*a* are attached to the interior surface 119 of base 66 of cap 62 at an intermediate point thereof while the distal tabs 158 are attached adjacent visor 158. The upper tab 160 may be used for attaching to interior surface of cap 62 adjacent the top 161 of opening 64 of cap 62.

It will be appreciated that a variety of different buttons 148, 162 may be used to connect the covering means to cap 62. Button 148 may have a light disposed therein, for example, for identifying the wearer in a dark environment. Button 148 may be permanently attached to cover 138 or may be selectively, detachably coupled to cover 138. Buttons 148, 162 may alternatively be permanently or selectively, detachably coupled to cap 62 separate from cover 138.

Buttons 148, 162 thus serve as examples of accessories to cover 138 and/or cap 62. As shown for example in FIG. 6, the invention further comprises means for selectively, detachably coupling buttons 148, 162 to cover and/or cap, such as male and female snap components 149, 151.

Another example of a headwear system 173 is shown in FIG. 7. Headwear system 173 includes a cap 174 and a variety of accessories which may be selectively, detachably coupled to the headband of cap 174 through the use of means for selectively, detachably coupling the accessory to one of the interior surface of the headband of cap 174 and the exterior surface of the headband of cap 174.

In one embodiment, the headband of cap 174 is disposed on or is integral with the interior surface (not shown) of base 175 of cap 174. In another embodiment, the interior surface of base 175 of cap 174 comprises the headband. The headband may include a first attachment member on the interior surface of base 175 of cap 174 which is releasably engaged by a second attachment member on the accessory.

As shown in FIG. 7, various accessories which are selectively, detachably coupled to the headband of cap 174, include cover 208, visor 142, means for protecting the neck of the wearer, such as neck shield 164, means for protecting at least one ear of the wearer, such as ear flaps 166, 168, and means for protecting the eyes of the wearer, such as eye shield 170.

In one embodiment, neck shield 164 has a second attachment member on an exterior side 166 thereof and a cushioning means on an interior side 180 thereof for cushioning the head of the wearer, such as terry cloth. By disposing the second attachment member against a corresponding first attachment member on the headband of cap 174, shield 164 is selectively, detachably coupled to the headband. In one embodiment, as shown in FIG. 7, the second attachment member comprises hook material 182, while the first attachment member comprises pile material (not shown).

Also as shown in FIG. 7, in one embodiment, each ear flap 166, 168 is comprised of a second attachment member on an exterior side 184, 186 thereof and a cushioning means on an interior side 188, 190 thereof for cushioning the head of the wearer, such as terry cloth. By disposing the second attachment member against a corresponding first attachment member on the headband of cap 174, each ear flap 166, 168 is selectively, detachably coupled to the headband. In one embodiment, the second attachment member comprises hook material, while the first attachment member comprises pile material (not shown).

Also as shown in FIG. 7, in one embodiment, the eye shield 170 includes a second attachment member on an exterior side 192 thereof and a cushioning means on an interior side 194 thereof for cushioning the head of the wearer, such as terry cloth. By disposing the second attachment member against a corresponding first attachment member on the headband, eye shield 170 is selectively, detachably coupled to the headband. In one embodiment, as shown in FIG. 7, the second attachment member comprises hook material 196, while the first attachment member comprises pile material. As shown, a rim 200 of eye shield 170 is hingeably mounted to a lens 202, such that lens 202 may be selectively oriented between an upper position (demonstrated by shadow lines) and a lower position. Lens 202 may be in the form of a sunglass lens or an eyeglass correctional lens, or an opaque, translucent, or transparent material, such as plastic, or any other type of lens, glass, plastic, or other material covering or disposed in front of at least one eye.

Visor 142 includes a bill 172 and a rim 96, rim 96 having a second attachment member on distal surface 206 thereof. In one embodiment, bill 172 is comprised of a transparent or translucent material having a design 42 deposited therein. Design 42 may constitute or at least appear similar to a slide sandwiched between two transparent or translucent visor plates. In one embodiment, this design is accomplished by laminating a photographic image, or other design between the visor plates. Optionally, bill 172 is comprised of an opaque material. In yet another embodiment, visor 142 includes a hinge (not shown) or is flexible at a proximal portion thereof, such that the bill 172 of visor 172 is selectively oriented between an upper position and a lower position.

Cover 208 includes tabs 210 for coupling to headband of cap 174. Thus, base 212 of cover 208 is selectively, detachably coupled to base 175 of cap 174.

Figure 8:
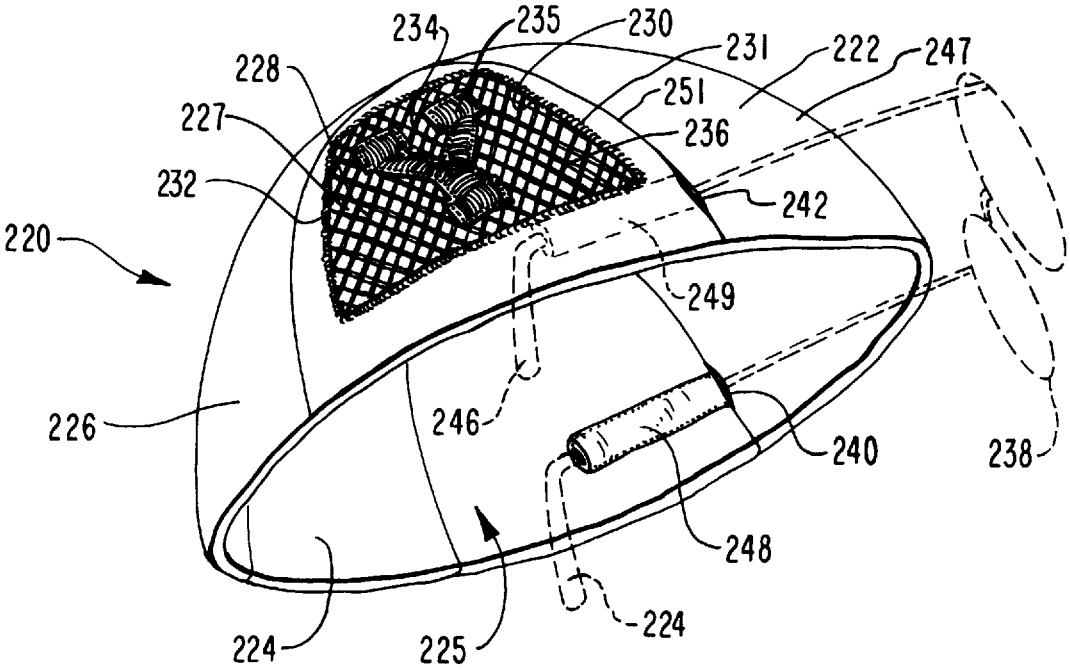
FIG. 8 is a perspective view of another modular headwear system of the present invention. Eyeglasses are shown in shadow lines.

Another embodiment of a headwear system 220 is shown in FIG. 8. Headwear system 220 comprises a cap 222 having an interior surface 224 and an exterior surface 226, interior surface 224 defining an interior cavity 225. Cap 222 has an aperture 227 extending from the interior surface 224 to the exterior surface 222 of cap 226. To partially cover aperture 227, first patch 228 is coupled to cap 222, such as by stitching the peripheral edges 230 of first patch 228 to the rim 232 of aperture 227 with stitching 231. Aperture 227 has the shape of first patch 228. First patch 228 is thus configured to fit within aperture 227 of cap 222.

First patch 228 includes means for venting the interior cavity 225 of cap 222, such as by being comprised of a mesh material 234 which provides allows air to flow between the environment and the interior cavity 225 of cap 222. As shown, an insignia 235 is stitched onto the mesh material 234. Thus, although first patch 228 partially covers aperture 227, first patch 228 allows a significant amount of airflow between the head of the wearer and the environment, promoting significant ventillation. Cap 222 may thus be comprised mostly of a wool material for example, while patch 228 provides significant ventillation and also bears an insignia 235.

In one embodiment, headwear system 220 further comprises (i) a second patch such as second patch 108 shown in FIG. 4, the second patch having a proximal surface and a distal surface, and (ii) means for selectively, detachably coupling the second patch to distal surface 236 of first patch 222. For example, in one embodiment, the means for selectively, detachably coupling the second patch to the distal surface 236 of first patch 222 comprises (i) a first attachment member on the distal surface of first patch 222 such as a pile or chenille material disposed on the periphery 230 of the distal surface 236 of first patch 222; and (ii) a second attachment member on the proximal surface of the second patch, such as a hook material on a corresponding portion of the proximal surface of the second patch.

By way of example, the first attachment member may be disposed on or be comprised of stitching 231. In another embodiment, the first attachment member is disposed on or is comprised of at least a portion of the mesh material 234. In addition the first attachment member may be disposed on or comprise insignia 235. In yet another embodiment of a venting means, entire cap 222 may be comprised of a mesh material, while an insignia is stitched into the mesh.

Headwear system 220 is also configured to selectively, detachably receive means for protecting the eyes of the wearer, such as eyeglasses 238. Eyeglasses 238 are thus another example of an accessory. This allows a wearer to stabilize the eyeglasses 238 on cap 222, thereby preventing eyeglasses 238 from falling off the user's head. Optionally the wearer can remove eyeglasses 238 from the user's eyes and or from the user's ears, yet maintain eyeglasses 238 in a stable, protected position coupled to the user's hat.

Headwear system 220 includes another example of means for selectively, detachably, coupling means for protecting the eyes of the wearer, such as eyeglasses 238, to cap 222. As shown in FIG. 8, in one embodiment, the means for selectively detachably coupling eyeglasses 238 to cap 222 comprises cap 222 including first and second eyeglass apertures 240, 242, each aperture 240, 242 extending from interior surface 224 of cap 222 to exterior surface 226 of cap 222. First eyeglass aperture 240 is configured to receive a first attaching member 244 of eyeglasses 238 and second eyeglass aperture 242 is configured to receive a second attaching member 246 of eyeglasses 238.

In one example, the means for selectively detachably coupling eyeglasses 238 to cap 222 further comprises tubes 248, 249 such as elastomeric tubes having a cloth material or other material disposed about the surfaces of the tubes, coupled to each of the apertures, by stitching for example, for receiving the respective attaching member. The sides of tubes 248, 249 may also be stitched to the interior surface 224 of cap. As shown in FIG. 8, in a preferred embodiment, cap contains six panels 247 and apertures 240, 242 are each located in a respective seam 251 of cap 222 between panels 247.

Eyeglasses 238 include sunglasses, correctional eyeglasses, and a variety of other forms of eyewear having at least one attaching member extending rearwardly from at least one sunglass lens or eyeglass correctional lens, or an opaque, translucent, or transparent material, such as plastic, or any other type of lens, glass, plastic, or other material covering or disposed in front of at least one eye. An attaching member may comprise a straight member or a member which curves somewhat around the ear (having earpieces 244, 246 shown in FIG. 8 for example), or any other beam or structure which connnects the lens or other material to an ear, the face, or another object, such as a cap.

As shown in FIG. 7, in another embodiment, the means for selectively detachably coupling the eyeglasses to the cap comprises first and second endless elastomeric bands 250, 252 coupled to cap 174, the first band 250 configured to receive first attaching member 244 of eyeglasses 238 and second band 252 configured to receive second attaching member 246 of eyeglasses 238. Endless bands 250, 252 may be coupled to the exterior or interior surface of cap 174 or both. In one embodiment, an interior pair of bands 254 is coupled to the interior surface of cap 174, while an exterior pair 250, 252 is coupled to the exterior surface of cap 174.

Similar to the apertures 240, 242 and tubes 248, 249 discussed above, the wearer is able to stabilize eyeglasses 238 by placing eyeglasses 238 through bands 250, 252. Both systems allow a wearer to exercise more vigorously while wearing eyeglasses 238 without fear of losing eyeglasses 238 or allow a wearer to temporarily remove eyeglasses 238 from the wearer's eyes and/or ears while still retaining eyeglasses 238 safely on cap 174. Eyeglasses 238 may be worn above or below visor 142. By disposing eyeglasses 238 on visor 142 and within apertures 240, 242, or bands 250, 252, a wearer is even more likely to preserve eyeglasses 238 from damage while not worn by the wearer.

A headwear system of the present invention may also include means for selectively detachably coupling eyeglasses 238 to a headband such as headband 12. For example, the headband may have apertures therein such as apertures 240, 242 or may have endless elastomeric bands such as bands 250, 252 coupled thereto, each of which serve as examples of means for selectively, detachably coupling a first accessory (e.g. eyeglasses 238) to one of the interior surface of the headband and the exterior surface of the headband. Tubes 248 may also be coupled to the apertures of the headband as discussed above with relation to cap 222.

The invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within the scope thereof.

What is claimed is:

1. A modular headwear system worn by a user, comprising:

a headband having an interior surface and an exterior surface;

a first accessory selected from a group comprising a visor and a cap; and means for selectively, detachably coupling the first accessory to any location on one of the interior surface of the headband and the exterior surface of the headband.

2. A modular headwear system as recited in claim 1, wherein the first accessory comprises a visor.

3. A modular headwear system as recited in claim 1, wherein the visor includes:

a bill having a proximal end and a distal end; and a rim having a distal surface and a proximal surface, the distal surface of the rim coupled to the proximal end of the bill; and wherein the means for selectively, detachably coupling the accessory to one of the interior surface of the headband and the exterior surface of the headband comprises:

a first attachment member on the headband; and a second attachment member on the rim of the visor, the second attachment member releasably engaging the first member.

4. A headwear system as recited in claim 1, further comprising:

a second accessory; and means for selectively, detachably coupling the second accessory to one of the interior surface of the headband and the exterior surface of the headband.

5. A headwear system as recited in claim 1, wherein the means for selectively, detachably coupling the first accessory to one of the interior surface of the headband and the exterior surface of the headband comprises means for selectively, detachably coupling the first accessory on the exterior surface of the headband.

6. A headwear system as recited in claim 1, wherein the first accessory comprises a cap, the cap having an interior surface and an exterior surface, the interior surface defining an interior cavity.

7. A headwear system as recited in claim 6, wherein the cap has a base, and further comprising means for covering the cap, the covering means having a base, wherein the base of the covering means includes a gathered portion for selectively, detachably coupling the base of the covering means to the base of the cap.

8. A headwear system as recited in claim 6, wherein the cap has a base, and further comprising means for covering the cap, the covering means having a base, wherein the base of the covering means includes at least one tab extending from the base of the cover for selectively, detachably coupling the base of the covering means to the base of the cap.

9. A headwear system as recited in claim 1, wherein the means for selectively, detachably coupling the first accessory to one of the interior surface of the headband and the exterior surface of the headband comprises means for selectively, detachably coupling the first accessory to the interior surface of the headband.

10. A modular headwear system worn by a user comprising:

a headband having an interior surface and an exterior surface;

a first accessory comprising a cap, the cap having an interior surface and an exterior surface, the interior surface defining an interior cavity;

means for selectivity, detachably coupling the cap to any location on the interior surface of the headband and an exterior surface of the headband; and a visor coupled to the headband, wherein the visor includes:

a bill having a proximal end and a distal end; and a rim having a distal surface and a proximal surface, the distal surface of the rim coupled to the proximal end of the bill; wherein the distal surface of the rim is selectively, detachably coupled to the interior surface of the headband, the rim further comprising means for venting the interior cavity of the cap.

11. A headwear system as recited in claim 10, wherein the means for venting the interior cavity of the cap comprises the rim comprising a hollow cavity.

12. A modular headwear system worn by a user, comprising:

a headband, fitting around the entire circumference of the wearer's head, having an interior surface and an exterior surface;

a first accessory;

means for selectively, detachably coupling the first accessory to one of the interior surface of the headband and the exterior surface of the headband; and a second accessory detachably coupled to the headband.

13. A headwear system as recited in claim 12, wherein the first accessory comprises means for covering at least one ear of the wearer.

14. A headwear system as recited in claim 12, wherein the first accessory comprises means means for covering the neck of the wearer.

15. A headwear system as in claim 12, wherein the first accessory comprises means for protecting the eyes of the wearer.

16. A modular headwear system as recited in claim 12, wherein the first accessory comprises a first patch.

17. A headwear system as recited in claim 12, wherein the second accessory comprises a cap, the cap having an interior surface and an exterior surface, the interior surface defining an interior cavity.

18. A headwear system as recited in claim 17, further comprising means for selectively, detachably coupling the cap to one of the interior surface of the headband and the exterior surface of the headband.

19. A modular headwear system worn by a user comprising:

a headband having an interior surface and an exterior surface;

a first accessory comprising a visor, the visor comprising:

a bill having a proximal end and a distal end;

a rim having a distal surface and a proximal surface, the distal surface of the rim coupled to the proximal end of the bill and to the interior surface of the headband; and means for venting the interior cavity of the cap;

means for selectively, detachably coupling the visor to the interior surface of the headband and the exterior surface of the headband; and a second accessory detachably coupled to the headband comprising a cap, the cap having an interior surface and an exterior surface, the interior surface defining an interior cavity.

20. A headwear system as recited in claim 19, wherein the means for venting the interior cavity of the cap comprises the rim including a hollow rim cavity defining a passageway extending between the upper end of the rim and the lower end of the rim, the hollow rim cavity permitting the flow of air between the interior cavity of the cap and the environment.

21. A modular headwear system worn by a user, comprising:

a cap having an interior surface and an exterior surface, the interior surface defining an interior cavity;

a first patch having a proximal surface and a distal surface; and means for selectively, detachably coupling the first patch to the cap;

a headband, fitting around the entire circumference of the wearer's head, having an interior surface and an exterior surface; and means for selectively, detachably coupling the cap to one of the interior surfaces of the headband and the exterior surface of the headband.

22. A modular headwear system worn by a user comprising:

a cap having an interior surface and an exterior surface, the interior surface defining an interior cavity;

a first patch having a proximal surface and a distal surface;

means for selectively, detachably coupling the first patch to the cap;

a second patch having a proximal surface and a distal surface; and means for selectively, detachably coupling the second patch to the distal surface of the first patch.

23. A headwear system as recited in claim 22, wherein the means for selectively, detachably coupling the second patch to the distal surface of the first patch comprises a first attachment member on the distal surface of the first patch; and a second attachment member on the proximal surface of the second patch; wherein the first attachment member is disposed adjacent insignia stitched on the distal surface of the first patch.

24. A modular headwear system worn by a user, comprising:

a cap having an interior surface and an exterior surface, the interior surface defining an interior cavity, the cap having an aperture formed therethrough;

a first accessory having a proximal surface and a distal surface, the first accessory being coupled to the cap so as to cover the aperture;

a second accessory having a proximal surface and a distal surface; and means for selectively, detachably coupling the second accessory to the distal surface of the first accessory, the means for selectively, detachably coupling the second accessory to the distal surface of the first accessory comprising:

a first attachment member on the distal surface of the first accessory; and a second attachment member on the proximal surface of the second accessory, the second attachment member releasably engaging the first attachment member.

25. A headwear system as recited in claim 24, wherein the first accessory is permanently coupled to the cap.

26. A headwear system as recited in claim 24, wherein the first accessory comprises a first patch having insignia.

27. A headwear system as recited in claim 26, wherein the second accessory comprises a second patch.

28. A headwear system as recited in claim 24, further comprising:

a headband having an interior surface and an exterior surface; and means for selectively, detachably coupling the cap to one of the interior surface of the headband and the exterior surface of the headband.

29. A modular headwear system worn by a user, comprising:

a cap having an interior surface and an exterior surface, the interior surface defining an interior cavity; and a visor coupled to the cap, the visor comprising:

a bill having a proximal end and a distal end; and a rim having a distal surface, a proximal surface, an upper end, and a lower end, the distal surface of the rim coupled to the proximal end of the bill, the rim further comprising means for venting the interior cavity of the cap.

30. A modular headwear system as recited in claim 29, wherein the means for venting the interior cavity of the cap comprises a hollow rim cavity defining a passageway extending between the upper end of the rim and the lower end of the rim, such that the hollow rim cavity permits the flow of air between the interior cavity of the cap and the environment.

31. A modular headwear system as recited in claim 29, further comprising:

a headband having an interior surface and an exterior surface; and means for selectively, detachably coupling the cap to one of the interior surface of the headband and the exterior surface of the headband.

32. A modular headwear system as recited in claim 31, wherein the headband is disposed between the visor and the cap.

33. A modular headwear system worn by a user, comprising:

a cap having an interior surface and an exterior surface, the interior surface defining an interior cavity, the cap having an aperture extending from the interior surface to the exterior surface of the cap; and a first patch coupled to the cap, the first patch configured to fit within the aperture, the first patch including means for venting the interior cavity of the cap.

34. A headwear system as recited in claim 32, further comprising a second patch having a proximal surface and a distal surface; and means for selectively, detachably coupling the second patch to a distal surface of the first patch.

35. A headwear system as recited in claim 34, wherein the means for selectively, detachably coupling the second patch to the distal surface of the first patch comprises a first attachment member on the distal surface of the first patch; and a second attachment member on the proximal surface of the second patch.

36. A modular headwear system worn by a user, comprising:

a cap having an interior surface and an exterior surface, the interior surface defining an interior cavity;

means for selectively, detachably coupling eyewear having an attaching member extending from a lens to any location on the cap.

37. A modular headwear system worn by the user comprising:

a cap having an interior surface and an exterior surface, the interior surface defining an interior cavity;

means for selectively, detachably coupling eyewear having an attaching member extending from a lens to the cap comprising the cap including first and second apertures, each aperture extending from the interior surface of the cap to the exterior surface of the cap; the first aperture configured to receive a first attaching member of the eyewear and the second aperture configured to receive a second attaching member of the eyewear.

38. A modular headwear system worn by the user comprising:

a cap having an interior surface and an exterior surface, the interior surface defining an interior cavity;

means for selectively, detachably coupling eyewear of the wearer to the cap comprising first and second endless bands coupled to the cap; the first band configured to receive a first attaching member of the eyewear and the second band configured to receive a second attaching member of the eyewear.

* * * * *